United States Patent [19]

Komaki

[11] Patent Number: 4,949,426

[45] Date of Patent: Aug. 21, 1990

[54] HINGE MECHANISM WITH TORSION BAR

[75] Inventor: Susumu Komaki, Osaka, Japan

[73] Assignee: Mita Industrial Co., Ltd., Osaka, Japan

[21] Appl. No.: 272,250

[22] Filed: Nov. 17, 1988

[30] Foreign Application Priority Data

Nov. 30, 1987 [JP] Japan ..... 62-303583
Aug. 10, 1988 [JP] Japan ..... 63-106456[U]

[51] Int. Cl.[5] ..... E05F 1/08
[52] U.S. Cl. ..... 16/308; 16/375
[58] Field of Search ..... 16/308, 297, 277, 363, 16/375, 376, 278, 289, 290, DIG. 36

[56] References Cited

U.S. PATENT DOCUMENTS

| | | | |
|---|---|---|---|
| 1,131,660 | 3/1915 | Bommer | 16/277 |
| 2,660,750 | 12/1953 | Wallen | 16/375 |
| 3,153,258 | 10/1964 | Badura | 16/308 |
| 3,339,969 | 9/1967 | Bridle et al. | 16/308 |
| 4,604,770 | 8/1986 | Lang | 16/375 |
| 4,785,501 | 11/1988 | Obana | 16/308 |

*Primary Examiner*—Nicholas P. Godici
*Assistant Examiner*—Carmine Cuda
*Attorney, Agent, or Firm*—Wenderoth, Lind & Ponack

[57] ABSTRACT

A frame connection member, which is fixedly mounted on one of an upper split frame and a lower split frame, is pivoted on the other split frame so as to revolve around a horizontal axis shaft line. An inversely tapered concavity for inserting a twisted shaft portion of a torsion bar from a direction meeting at right angles with the axis shaft line of the shaft portion is formed in the frame connection member. The frame connection member is provided with a first engagement member for engaging a biasing reaction force portion on one end side of the torsion bar, the other split frame being provided with a second engagement member for engaging a biasing reaction force portion on the other end side of the torsion bar. The other split frame has a revolution regulating member for regulating a revolving range of the frame connection member relative to the other split frame at a range larger than a predetermined open angle set by an angle regulating device. The torsion bar is simply and easily set by inserting the twisted shaft portion of the torsion bar into the inversely tapered concavity sideways and slightly twisting the twisted shaft portion.

7 Claims, 10 Drawing Sheets

FIG. 12
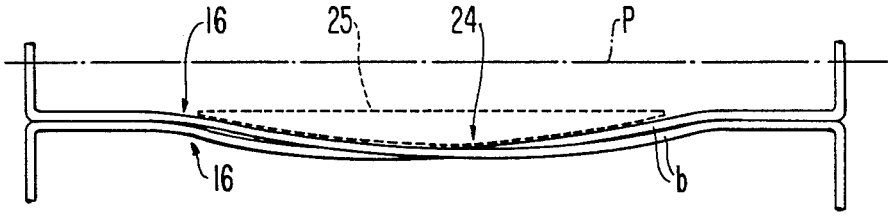
FIG. 13
(PRIOR ART)
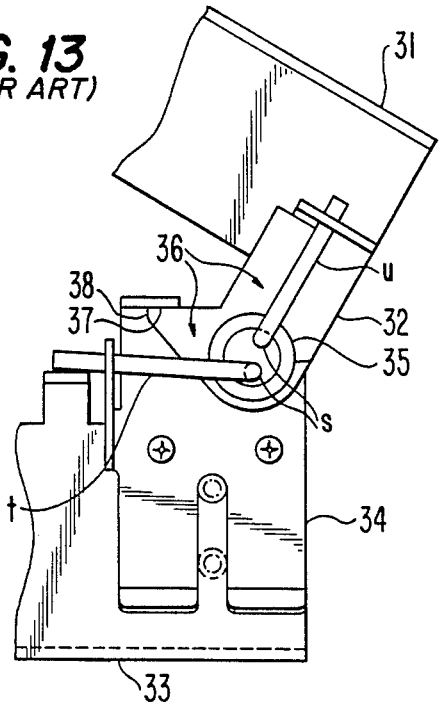
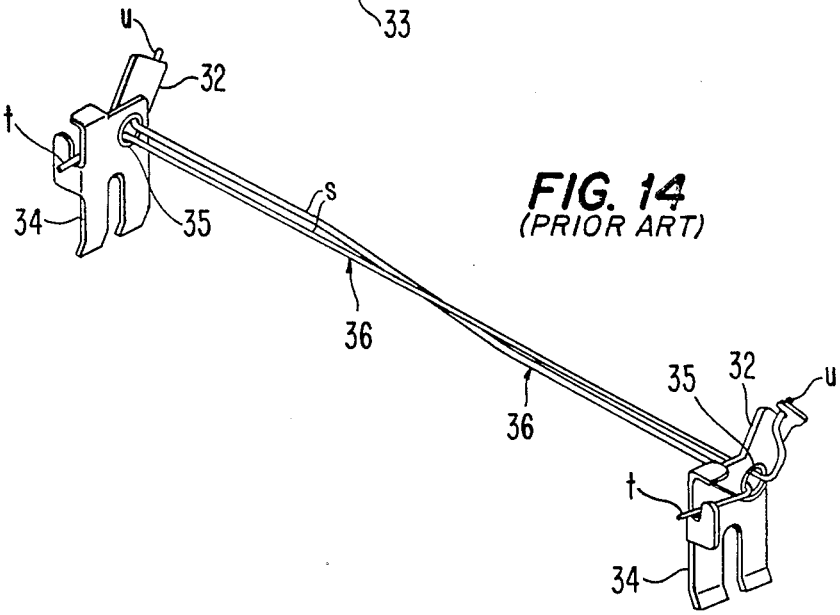
FIG. 14
(PRIOR ART)

HINGE MECHANISM WITH TORSION BAR

BACKGROUND OF THE INVENTION 1. (Field of the Invention)

The present invention relates to a frame opening and closing mechanism provided with a torsion bar for a clamshell type image forming apparatus, such as an electrostatic photographic copying machine and facsimile machine, and the like. In particular, the present invention relates to a frame opening and closing mechanism provided with a torsion bar which has an upper split frame connected with a lower split frame so as to be opened and closed around a horizontal axis shaft line, a connecting portion for biasing the upper split frame in an opened direction, and an opening regulator for allowing the upper split frame to be opened to a predetermined open angle.

2. (Prior Art)

FIGS. 13 and 14 show a prior art frame opening and closing mechanism which uses a torsion bar. In order to bias the upper split frame in the open direction in the frame opening and closing mechanism, a connection member 32 is connected with both sides of the upper split frame in a back and forth direction (a direction meeting at right angles with the paper surface in FIG. 13) of the upper split frame 31. A frame connection member 34 is connected with a lower split frame 33 and pivots on the connection member 32 through a cylindrical connection 35. Two cranklike torsion bars 36, 36 are each provided with bent ends inserted into the cylindrical connection 35, and a twisted shaft portion s of the torsion bar 36 is twisted so as to connect a biasing reaction force portion t of each torsion bar 36 on the frame connection member 34. Another biasing reaction force portion u is on the connection member 32, giving a biasing force in the open direction to the upper split frame 31, as disclosed, for example, in Japanese Utility Model Laid-Open No. Sho 62-82670, and here shown in FIGS. 13 and 14.

However, since the biasing reaction force portions t, u of the above described torsion bars 36, 36 are bent, disadvantages have occurred, in that they are remarkably difficult to insert into the cylindrical connection 35. It is required, for giving a sufficient biasing force in the opened direction to the split frame 31 under the opening regulating condition of the upper split frame 31, that a revolution regulating member 37 is engaged with an openness regulating member 38, and that the twisted shaft portion s of the torsion bar 36 be greatly twisted in order to be set on both the members 32, 34, thus expending much labor.

SUMMARY OF THE INVENTION

The present invention has been achieved in view of the above described disadvantages of the prior art. Thus, it is an object of the present invention to provide a frame opening and closing mechanism capable of easily connecting the torsion bar without increasing the number of constituent members of the frame opening and closing mechanism.

In order to achieve the above described object, a frame opening and closing mechanism provided with a torsion bar according to the present invention comprises an upper split frame connected with a lower split frame so as to be opened and closed around a horizontal axis shaft line, a torsion bar provided on the connecting portion for biasing the upper split frame in an opened direction, and an opening regulator for regulating the upper split frame to open to a predetermined open angle. A frame connection member, fixedly mounted on one of the upper split frame and the lower split frame, is pivoted on the other split frame so as to be revolved around the horizontal axis shaft line. An inversely tapered concavity for inserting a twisted shaft portion of the torsion bar from a direction meeting at right angles with the axis shaft line of the shaft is formed in the frame connection member, the frame connection member being provided with a first engagement member for engaging a biasing reaction force portion on one end side of the torsion bar. The other split frame is provided with a second engagement member for engaging a biasing reaction force portion on the other end side of the torsion bar, and the other split frame also is provided with a revolution regulating member for regulating the revolving range of the frame connection member relative to the other split frame at a range larger than an open angle of the opening regulator.

According to the above described characteristic construction, the connection of the torsion bar giving the biasing force to the upper split frame in the opened direction can be achieved by inserting the torsion bar into the inversely tapered concavity formed in the frame connection member, such that the frame connection member is pivoted on the other split frame and engages both end biasing reaction force portions of the torsion bar with the first and second engagement members.

Upon connecting the frame connection member with the one split frame, rotating the other split frame in the closing direction until the predetermined open angle or less, and providing the opening regulator, the installment of the upper split frame, which is regulated at the predetermined open angle relative to the lower split frame, is completed.

Figure 9:
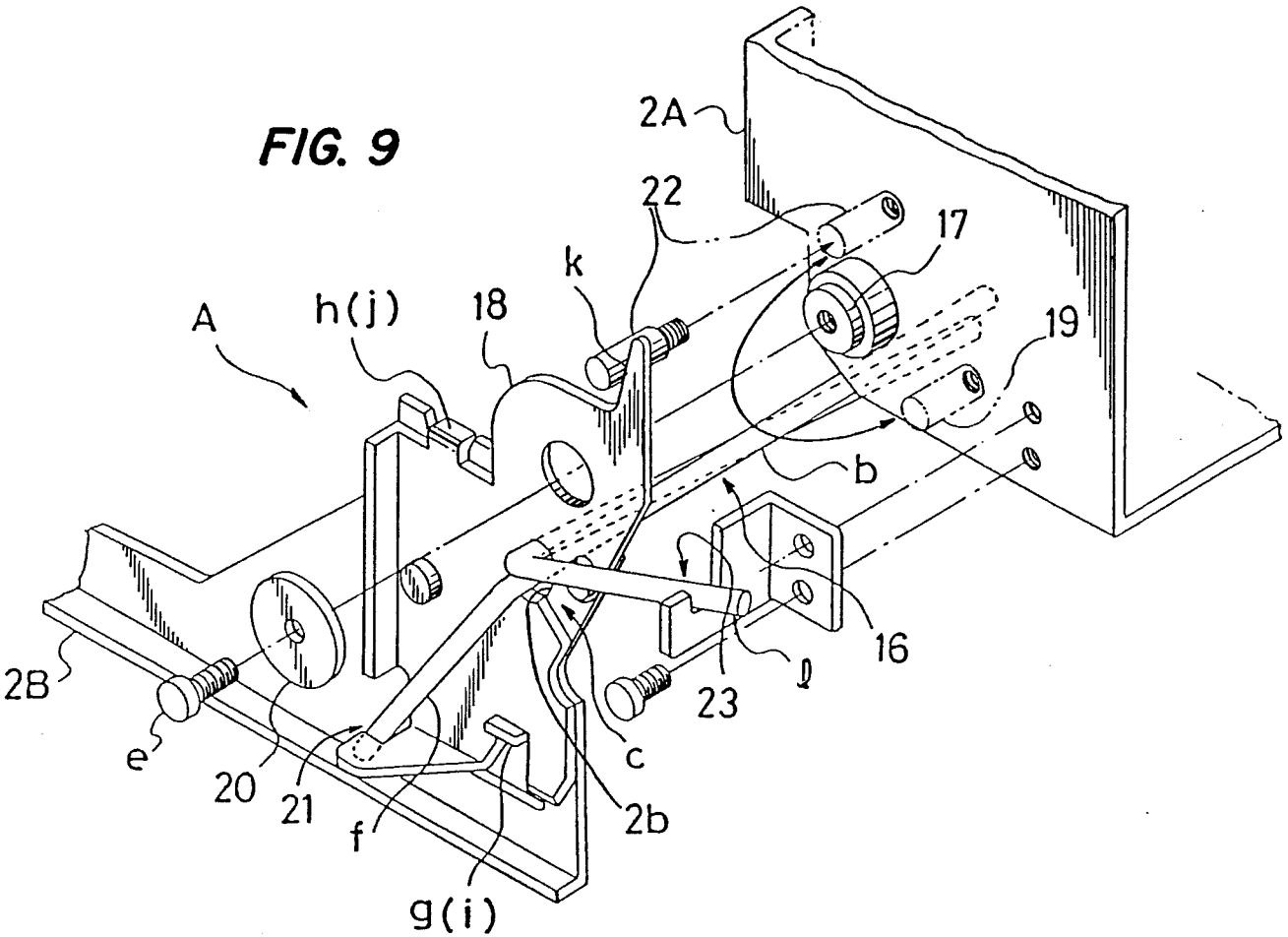
Figure 11:
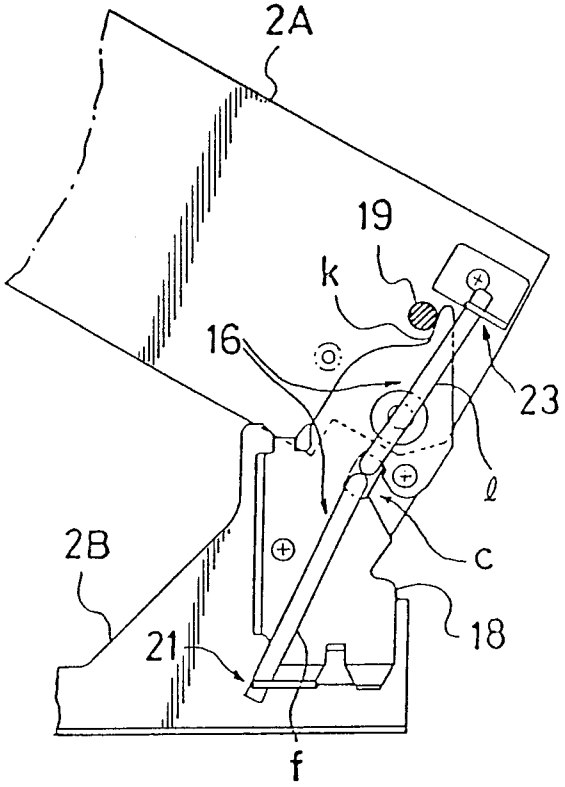
Figure 10:
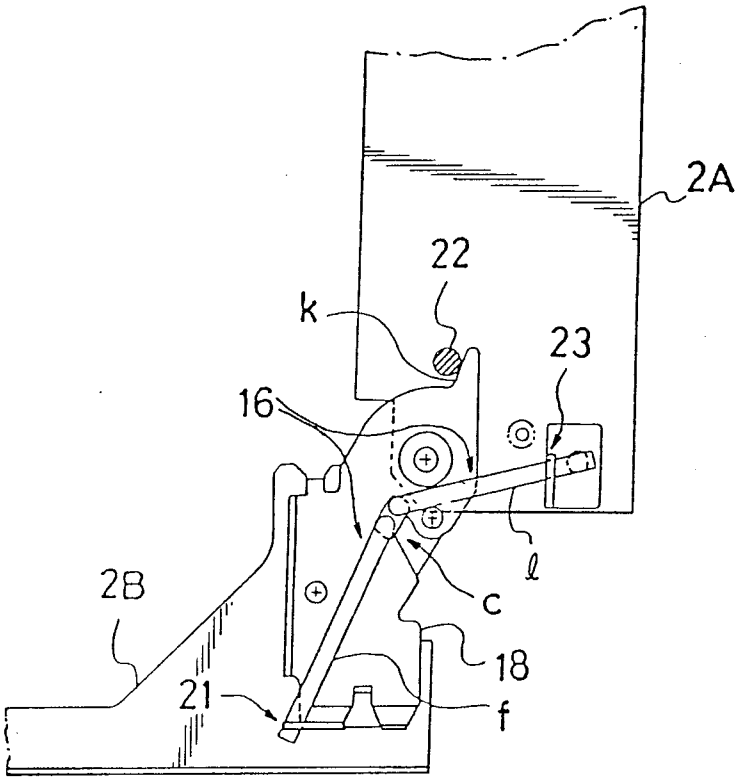

Another preferred embodiment of the frame opening and closing mechanism is shown in FIGS. 9 to 11, wherein:

FIG. 9 is a detailed perspective view of the frame opening and closing mechanism according to the second preferred embodiment;

FIG. 10 is a side view showing the condition in which the revolving range of a frame connection member is regulated; and FIG. 11 is a side view showing the condition in which the open angle of an upper split frame is regulated.

FIG. 12 is a front view showing a torsion bar according to another preferred embodiment;

FIG. 13 is a side view of a conventional frame opening and closing mechanism provided with torsion bars; and FIG. 14 is a perspective view of the conventional frame opening and closing mechanism of FIG. 13.

DESCRIPTION OF THE PREFERRED EMBODIMENTS

Figure 1:
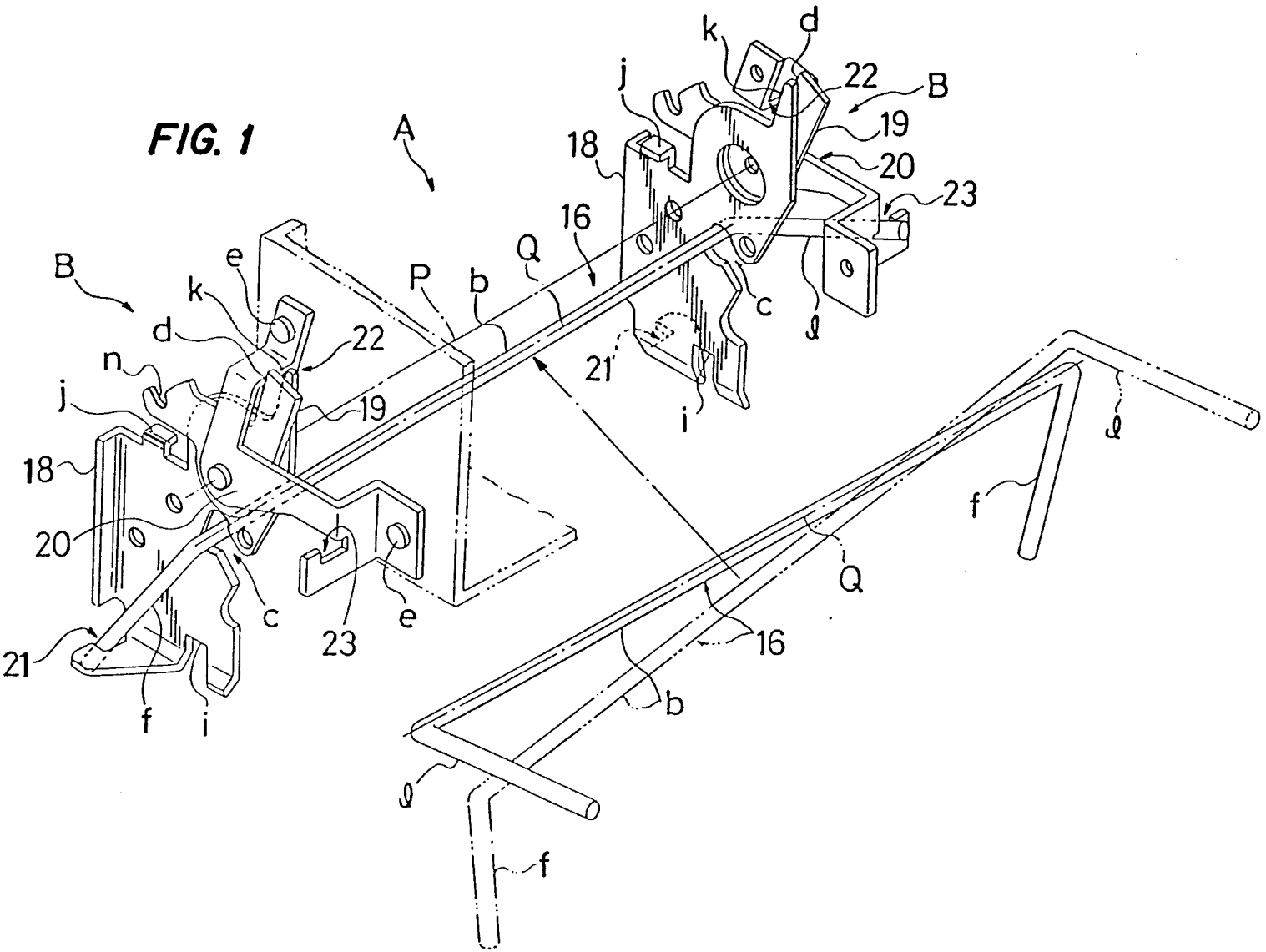
FIG. 1 is a perspective view showing a frame opening and closing mechanism according to the present invention.
Figure 2:
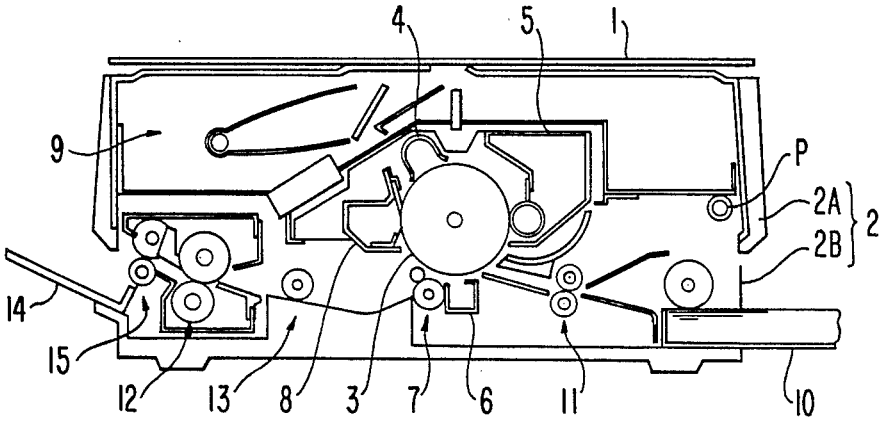
FIG. 2 is a longitudinal sectional view showing an electrostatic photographic copying machine to which the frame opening and closing mechanism of the present invention may be applied.
Figure 3:
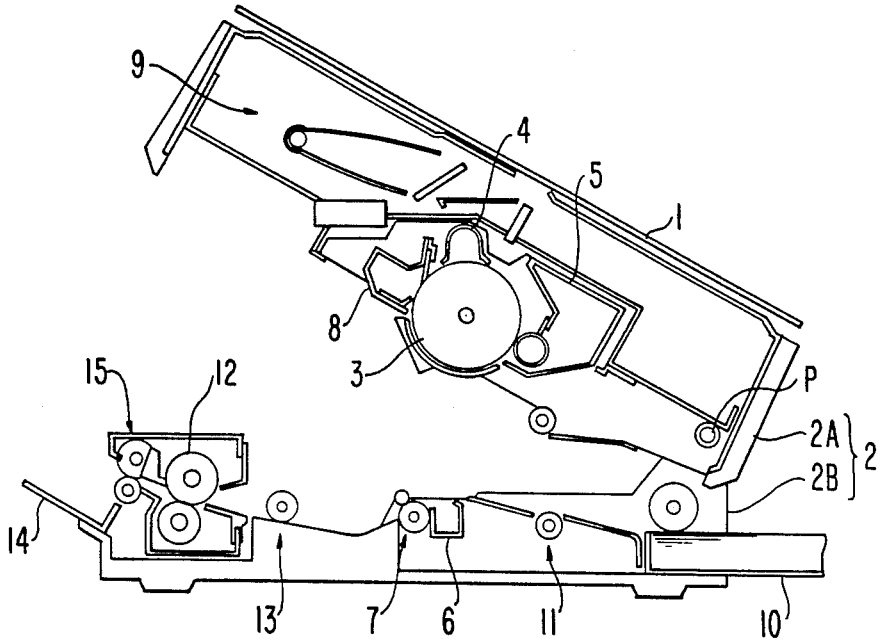
FIG. 3 is a longitudinal sectional view showing an opened condition of an upper split frame of the electrostatic photographic copying machine of FIG. 2.

The preferred embodiments of the present invention are described below with reference to the drawings. FIG. 1 is a detail drawing showing a frame opening and closing apparatus A. FIGS. 2 and 3 are schematic drawings showing a so-called clamshell type electrostatic photographic copying machine. In this copy machine a photoreceptor 3 is mounted on a frame 2 of the copying machine. The copying machine is also provided with a document table 1, which is reciprocable in a paper supply direction. An electrifying apparatus 4, a developing apparatus 5, a transferring apparatus 6, a paper-separating apparatus 7 and a cleaning apparatus 8 are disposed in order around the photoreceptor 3. An exposure apparatus 9 is disposed in a space above the cleaning apparatus 8, and a paper-conveying apparatus 11 for conveying papers housed in a cassette case 10 to the transferring apparatus 6, a discharged paper-conveying apparatus 13 for conveying separated papers to a fixation apparatus 12 and a pair of paper-discharging rollers 15 for discharging rollers 15 for discharging fixed papers to a tray 14 are provided.

The frame 2 of the copying machine is divided into two parts, an upper split frame 2A and a lower split frame 2B, with a paper supply course forming a border therebetween. The frame opening and closing apparatus A is provided so as to extend over both the split frames 2A, 2B on the upstream side of the paper supply course in the paper supply direction. This enables the upper split frame 2A, having the photoreceptor 3, the exposure apparatus 9 and the like to be swung open and closed around a horizontal axis shaft line P, under the condition that a locking mechanism (not shown) disposed on the downstream side of the paper supply course is released.

The frame opening and closing apparatus A is provided with two sets of connection structures B, B, symmetric in construction with respect to each other. Two torsion bars 16, 16 extend between the two sets of connection structures B, B.

Figure 4:
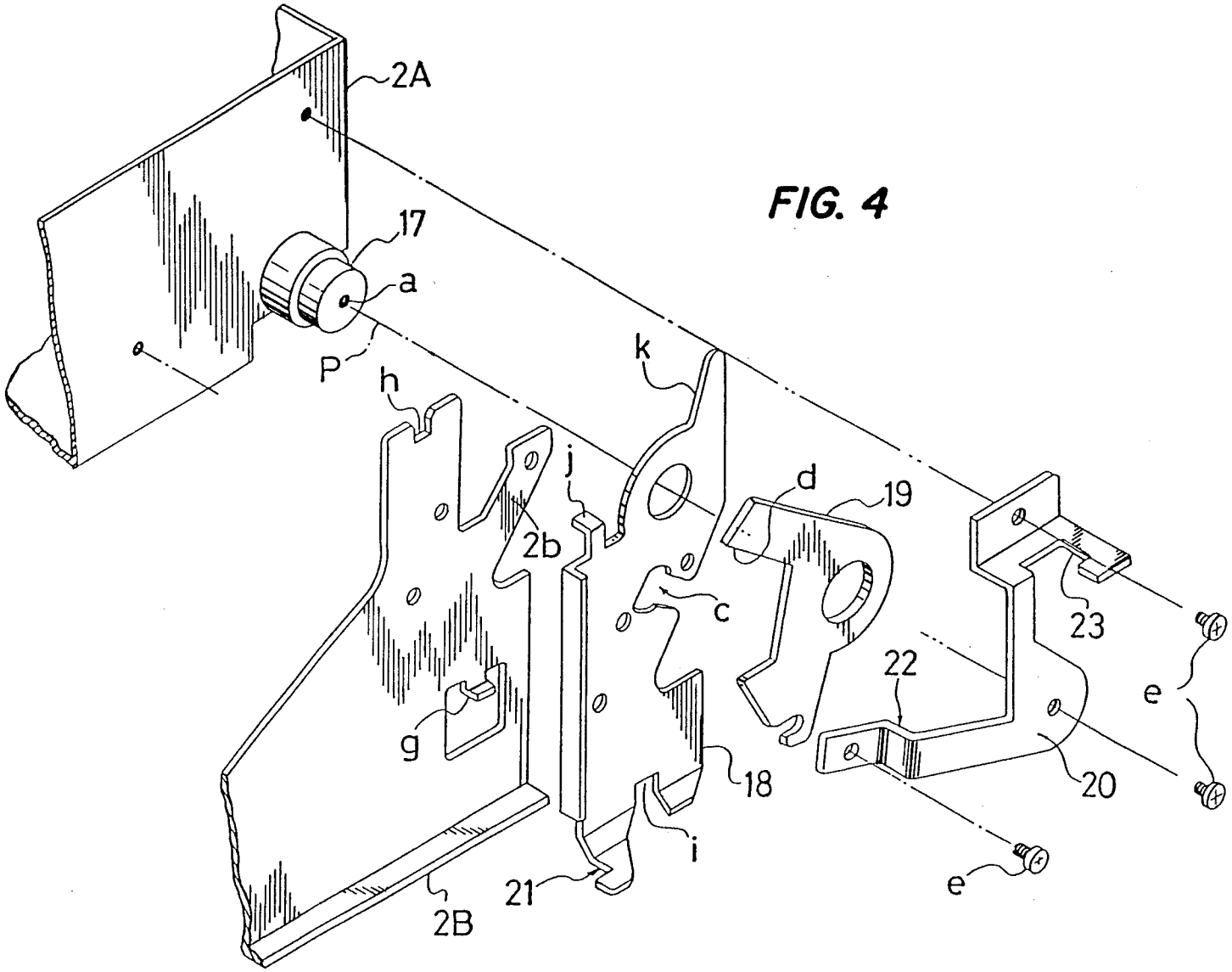
FIG. 4 is a perspective view of a detail of a connection structure of the frame opening and closing mechanism.

As shown in FIG. 4, a connection shaft 17 has a threaded hole a at an end portion thereof and is provided on the upper split frame 2A so that the axis of the connection shaft 17 may be coaxial with the horizontal axis shaft line P. An inversely tapered concavity c for having a twisted shaft portion b of a torsion bar 16 inserted therein from a direction perpendicular to an axis Q of the shaft portion b is formed in a frame connection member 18 connected with the lower split frame 2B by a machine screw. The frame connection member 18 and regulating device 19 having a regulating portion d are rotatably held on the connection shaft 17. A member 20 for preventing the regulating device 19 and the frame connection member 18 from coming off of the connection shaft 17 is fixedly mounted on the upper split frame 2A and the connection shaft 17 by machine screws e.

A first engagement member 21 engages a first biasing reaction force portion f of the torsion bar 16. A concave portion i engages a connecting projection g and a projection j engages with a concave portion h of the lower split frame 2B. A portion or stop member k to be regulated in revolution by a revolution regulating member or fixed member 22, which will be discussed later, is formed in the frame connection member 18. A second engagement member 23 for engaging a second biasing reaction force portion l of the torsion bar 16 and the revolution regulating member 22 for the portion k to be regulated in revolution are formed in member 20.

The portion k to be regulated in revolution of the above described frame connection member 18 is brought into contact with the revolution regulating member 22 when the twisted shaft portion b of the torsion bar 16 is twisted, so that the upper split frame 2A may be slightly biased in the opened direction and the biasing reaction force portions f, l of the torsion bar 16 are engaged with the first engagement member 21 and the second engagement member 23, and the regulating device 19 is rotatable under the above described condition (refer to FIG. 1).

Figure 5:
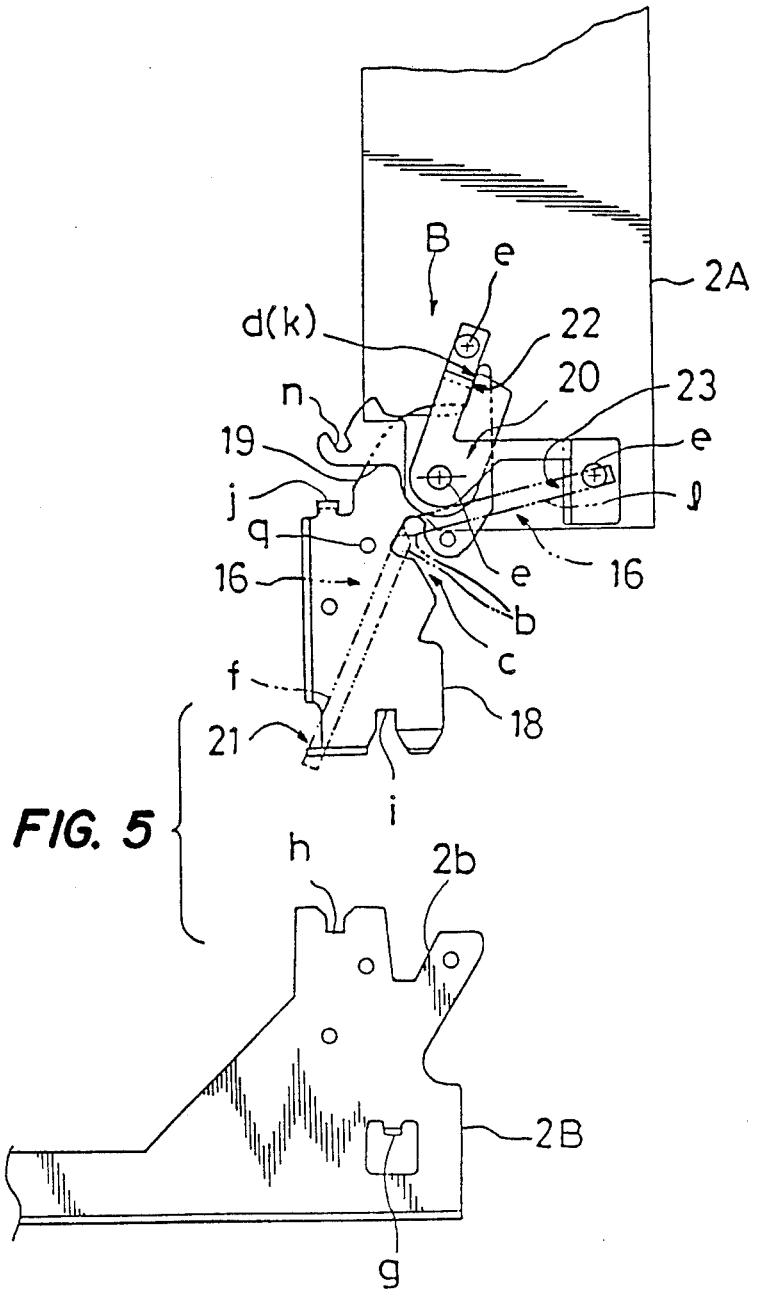
FIG. 5 is a side view showing the condition in which the frame opening and closing mechanism is set on the upper split frame.

Next, a procedure for connecting the upper split frame 2A with the lower split frame 2B will be described. First, as shown in FIGS. 1, 4 and 5, the frame connection member 18 and the regulating device 19 are held on the connection shaft 17 in an engaged manner, and the member 20 is fixedly mounted on the upper split frame 2A to install the two sets of connection structures B, B on the upper split frame 2A.

The twisted shaft portion b of the first torsion bar 16 is inserted into the inversely tapered concavities C,C of both frame connection members 18, 18. The twisted shaft portion b of the torsion bar 16 is slightly twisted so as to give a biasing force to the upper split frame 2A in the opened direction and engage one biasing reaction force portion f with the first engagement member 21 and the other biasing reaction force portion l with the second engagement member 23.

When the biasing reaction force portions f, l are engaged with the engagement members 21, 23 such that the twisted shaft portion b is slightly twisted, the shaft portion b adjacent to the biasing reaction force portion f is engaged with a lower concave portion of the inversely tapered concavity c in an energized manner, and the shaft portion b adjacent to the other biasing reaction force portion l is engaged with an upper concave portion of the inversely tapered concavity c by the reaction force acting upon the twisted shaft portion b. The torsion bar 16 is thus prevented from coming out of the above described inversely tapered concavity c. On the other hand, the revolving range of the frame connection member 18 relative to the upper split frame 2A is regulated by bringing the portion k of the frame connection member 18 into contact with the revolution regulating member 22 of the member 20.

The above described relationships and structure similarly hold true for the second torsion bar 16. That is to say, the torsion bars 16, 16 can be surely prevented from coming out by the setting and installation operation itself, in spite of the remarkably easy installation on both the engagement members 21 and 23.

Figure 6:
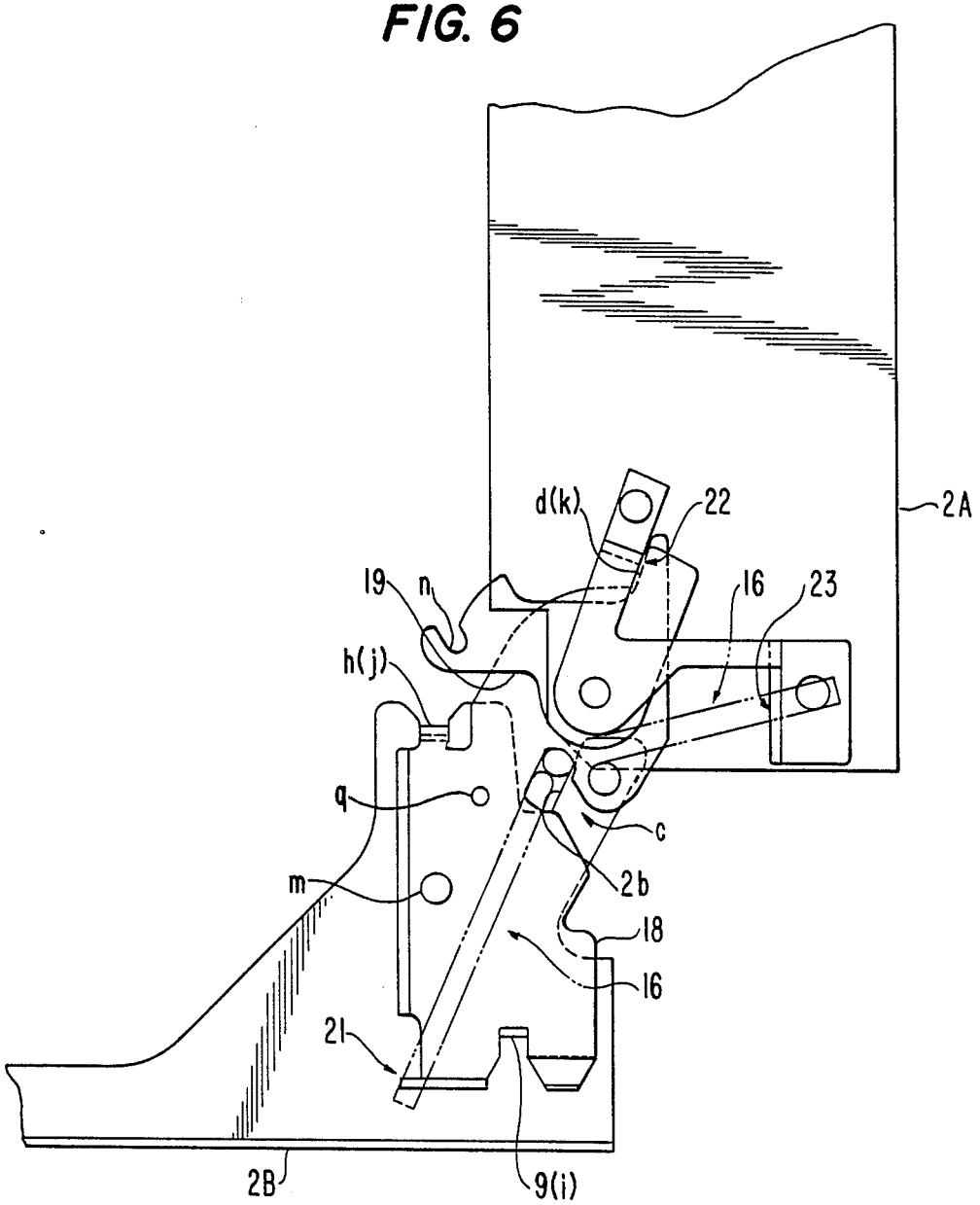
FIG. 6 is a side view showing the condition in which a revolving range of a frame connection member of the frame opening and closing mechanism is regulated.

Thus, the revolving range of the frame connection member 18 is regulated, against the reaction force of said torsion bar 16, to integrate the frame connection member 18 in the upper split frame 2A. As shown in FIG. 6, the concave portion i and the projection j of the frame connection member 18 are engaged with the connecting projection g and the concave portion h, respectively, of the lower split frame 2B, and the frame connection member 18 is fixedly mounted on the lower split frame 2B by a machine screw m.

Under this fixedly mounted condition, the opening of the inversely tapered concavity c of the frame connection member 18 is closed by the closing member **2*b* connected with the lower split frame 2B**.

Figure 7:
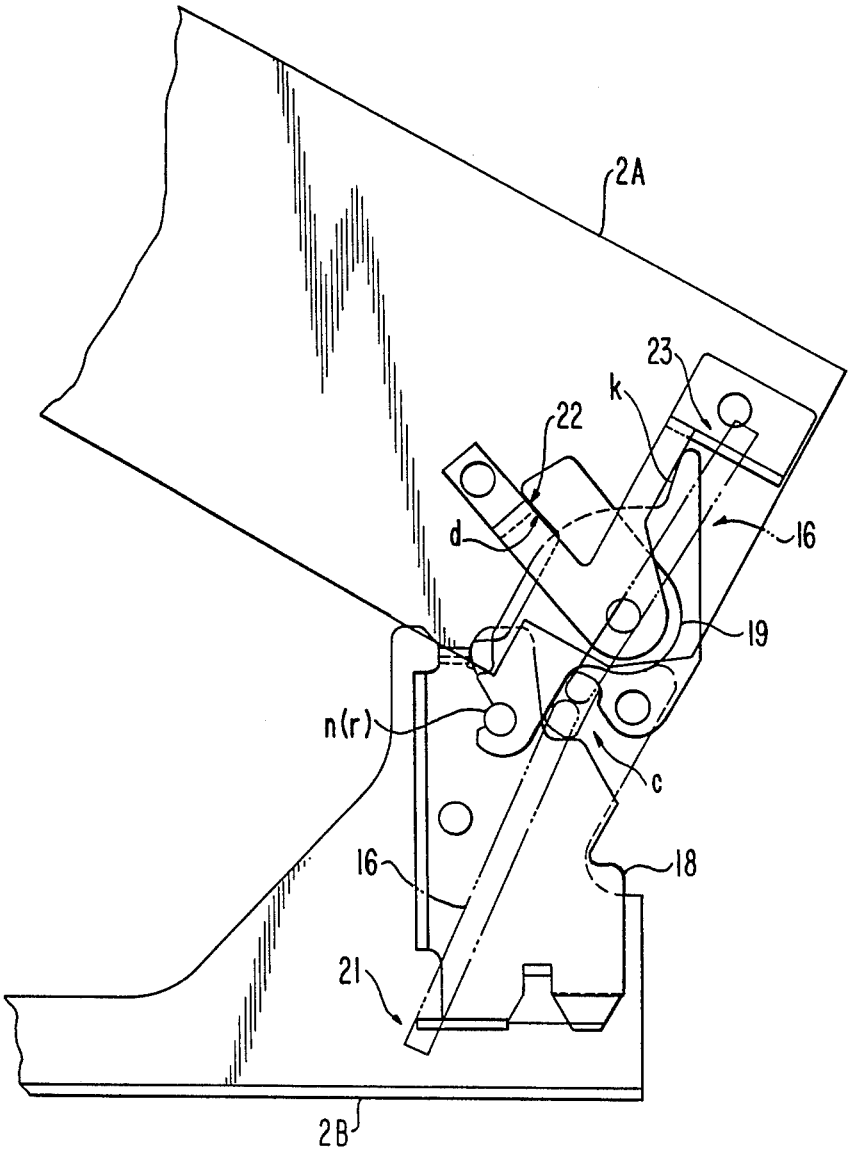
FIG. 7 is a side view showing the condition in which an open angle of the upper split frame is regulated.

Subsequently, as shown in FIG. 7, the upper split frame 2A is closed until a predetermined open angle, and then the regulating device 19 is revolved to bring the portion d of the regulating device into contact with the revolution regulating member 22.

Figure 8:
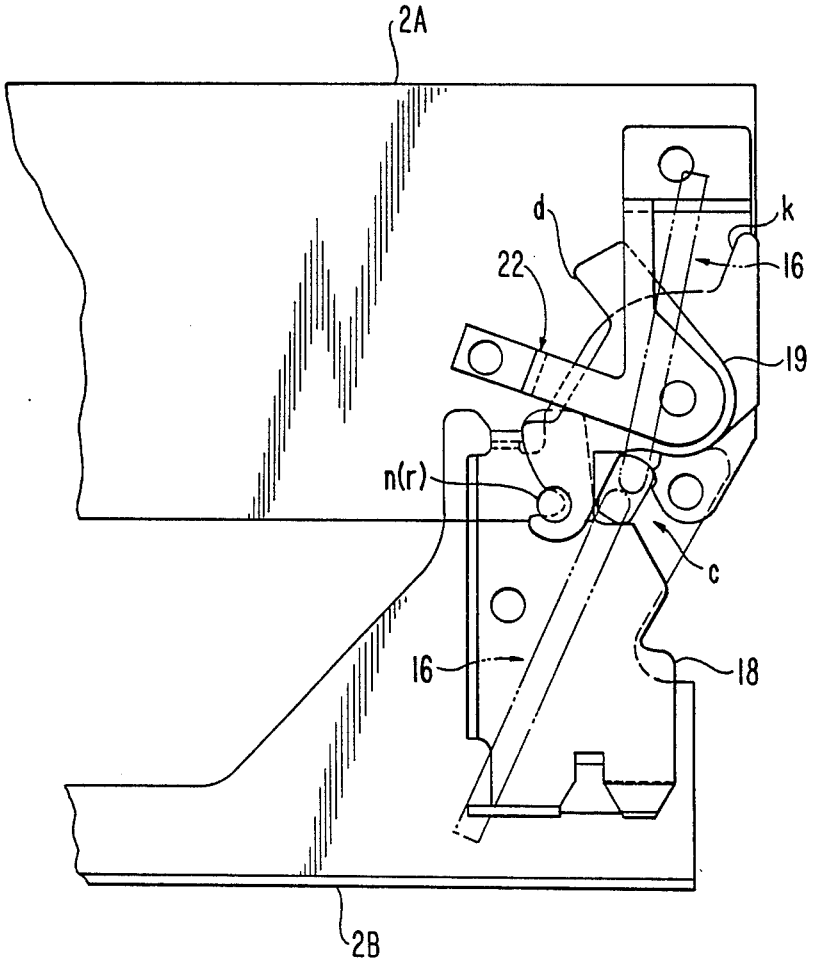
FIG. 8 is a side view showing a completely closed condition of the upper split frame.

A machine screw r is then screwed in a threaded hole g of the frame connection member 18 corresponding to a notch n of the regulating device 19, whereby an opening angle of the upper split frame 2A is set at the above described predetermined open angle. FIG. 8 shows a completely closed condition of the upper split frame 2A.

In short, the connection structures B, B are mounted on both sides of the upper split frame 2A, and then the torsion bars 16, 16 are set through the inversely tapered concavity c such that a biasing force is slightly given. Subsequently, the frame connection member 18 is connected with the lower split frame 2B and the open angle of the upper split frame 2A is set at the predetermined value.

Next, another preferred embodiment of the frame opening and closing mechanism A will be described with reference to FIGS. 9 to 11. This preferred embodiment is different in construction from the above described preferred embodiment in the following points.

In contrast to the construction in the above described preferred embodiment, wherein the revolution regulating member 22, with which the portion k to be regulated in revolution and portion d to be regulated in openness are brought into contact, and the second engagement member 23 for engaging the biasing reaction force portion l of the torsion bar 16 are formed integrally with the member 20, in this second preferred embodiment the second engagement member 23 is itself provided on the upper split frame 2A. Further, a threaded pin construction is given to the revolution regulating member 22, here a contact member. The portion k of the frame connection member 18 is brought into contact with member 22 when the twisted shaft portion b of the torsion bar 16 is slightly twisted to engage the engagement members 21, 23, because the revolution regulating member 22 is screwed in the upper split frame 2A (refer to FIG. 10). The revolution regulating member 22 is drawn out when the upper split frame 2A is regulated at the predetermined open angle to be screwed in to the upper split frame 2A and serve as the regulating device 19 (refer to FIG. 11).

That is to say, a special feature is that the revolution regulating member 22 is adapted to be usable also as the regulating device 19.

Next, another preferred embodiment of the torsion bar 16 for biasing the upper split frame 2B in the opened direction will be discussed with reference to FIG. 12.

In this case, a bent portion 24, eccentric in the direction meeting at right angles with the axis shaft line of the twisted shaft portion b of the torsion bar 16, is formed in the twisted shaft portion b, of each torsion bar 16. The upper split frame (not shown) is connected with the lower split frame (not shown) so as to be opened and closed around the horizontal axis shaft line P. The eccentric direction of the bent portion 24 is set so that the bent portions 24 of the two torsion bars 16 may be eccentrically positioned in a direction away from the horizontal axis shaft line P, such that the two torsion bars 16 are set over both split frames.

Since movement is small in the vicinity of the connecting portion of both split frames, i.e. around the horizontal axis shaft line P, even during the opening and closing operation of the upper split frame, the switches and the like, such as a paper supply switch or a paper discharging switch, are suitably disposed around the horizontal axis shaft line P.

However, the twisted shaft portion b of the torsion bar 16 is in the vicinity of the horizontal axis shaft line P, and the twisted shaft portion b has a linear form, as shown in FIG. 1, whereby the twisted shaft portion b stands in the way, so that switches and the like can only be installed away from the horizontal axis shaft line P.

But the switches and the like can be suitably disposed around the horizontal axis shaft line P by forming the bent portion 24 in the twisted shaft portion b of the torsion bar 16 and keeping the bent portion 24 away from the horizontal axis shaft line P, such that the torsion bar 16 forms a space 24 as shown by a broken line in FIG. 12.

Although the connection structures B, B are provided on the upper split frame 2A and the frame connection member 18 of the connection structures B, B is connected with the lower split frame 2B in the above described respective preferred embodiments, a construction in which the connection structures B, B are provided on the lower split frame 2B and the frame connection member 18 of the connection structures B, B is connected with the upper split frame 2A may be used. Furthermore, the frame opening and closing mechanism A having the above described construction can be applied to an image forming apparatus, such as facsimile machines and printers, as well as other various kinds of frame opening and closing structures, in addition to an electrostatic photographic copying machine.

As described above, with the frame opening and closing mechanism provided with a torsion bar according to the present invention, the setting of the torsion bar giving a biasing force to the upper split frame in the opened direction is achieved by inserting the torsion bar into the inversely tapered concavities formed in the frame connection members such that the frame connection member is pivoted on the other split frame and engages both end biasing reaction force portions of the torsion bars with the first and second engagement members so that the twisted shaft portion of each torsion bar is slightly twisted. That is, the setting of the torsion bar can be very simply and easily achieved by merely inserting the twisted shaft portion of the torsion bar into the inversely tapered concavity sideways and slightly twisting the twisted shaft portion.

The open angle of the upper split frame can then be set at the predetermined value by connecting the frame connection member with the one split frame, rotating the other split frame in the closing direction to the predetermined open angle or less, and providing the regulating device, whereby the conventional disadvantages are eliminated, despite the relatively simple improvement, as a whole.

What is claimed is:

1. A frame opening and closing mechanism, comprising:

an upper split portion of a frame and a lower split portion of a frame;

a torsion bar for biasing said upper split portion in an opening direction, said torsion bar comprising a shaft portion and a biasing reaction force portion extending from each end of said shaft portion;

a frame connection member fixedly mounted on one of said upper split portion and said lower split portion, said frame connection member comprising means for pivotably mounting the other of said upper split portion and said lower split portion thereto for pivotal movement about an axis line and an inversely tapered concave portion for receiving said shaft portion of said torsion bar therein;

a first engagement member on said frame connection member for engaging a said biasing reaction force portion extending from one end of said torsion bar;

a second engagement member on the other of said upper split portion and said lower split portion for engaging said biasing reaction force portion extending from the other end of said torsion bar;

means, at least a portion of which is disposed on the other of said upper split portion and said lower split portion, for regulating the amount which said upper split portion can be opened relative to said lower split portion by setting a predetermined angular opening limit, and for regulating the extent to which said frame connection member can pivot relative to the other of said upper split portion and said lower split portion by setting a pivoting range, said pivoting range being greater than said predetermined angular limit.

2. The frame opening and closing mechanism as set forth in claim 1, and further comprising:

a member on said one of said upper split portion and said lower split portion for closing off an open end of said inversely tapered concave portion of said frame connection member.

3. The frame opening and closing mechanism as set forth in claim 1, wherein:

said means for regulating comprises a pivot member pivotably mounted on said other of said upper split portion and said lower split portion for movement about said axis line but fixedly attachable to said one of said upper split portion and said lower split portion to establish said predetermined angular limit, and a fixed member fixedly mounted to said other of said upper split portion and said lower split portion so as to be engageable with said pivot member to stop opening movement of said upper split portion at said predetermined angular limit.

4. The frame opening and closing mechanism as set forth in claim 3, wherein:

said means for regulating further comprises a stop member for stopping pivoting movement of said frame connection member relative to said other of said upper and lower split portions to limit movement to said pivoting range when said pivot member is not fixedly attached to said one of said upper and lower split portions.

5. The frame opening and closing member as set forth in claim 1, wherein:

said means for regulating comprises a stop member on said frame connection member, first and second positions on said other of said upper and lower split portions corresponding to said predetermined angular limit and said pivoting range, respectively, and a contact member interchangeably fixably attachable to said other of said upper and lower split portions at said first and second positions.

6. The frame opening and closing mechanism as set forth in claim 1, wherein:

said torsion bar comprises an eccentric bent portion in said shaft portion eccentric in a direction away from said axis line.

7. A frame opening and closing mechanism for opening and closing an upper split portion of a frame relative to a lower split portion of the frame, said frame opening and closing mechanism comprising:

a pair of torsion bars for biasing an upper split portion the opening direction, said torsion bars each comprising a shaft portion and a biasing reaction force portion extending from each end of said shaft portion;

a pair of frame connection members fixedly mountable on opposite sides of one of the upper split portion and the lower split portion, each said frame connection member comprising means for pivotably mounting the other of the upper split portion and the lower split portion thereto for pivotal movement about an axis line and an inversely tapered concave portion for receiving said shaft portions of said torsion bars therein;

a pair of first engagement members on respective said frame connection members, each for engaging a said biasing reaction force portion extending from one end of a respective torsion bar;

a pair of second engagement members for disposition on the other of the upper and lower split portions, each for engaging the said biasing reaction force portion extending from the other end of a respective torsion bar;

means, at least a portion of which is disposable on the other of the upper split portion and the lower split portion, for regulating the amount which the upper split portion can be opened relative to the lower split portion by setting a predetermined angular opening limit, and for regulating the extent to which said frame connection member can pivot relative to the other of the upper split portion and the lower split portion by limiting the setting of a pivoting range, said pivoting range being greater than said predetermined angular limit.

* * * * *